US009478211B2

(12) United States Patent
Miki et al.

(10) Patent No.: US 9,478,211 B2
(45) Date of Patent: Oct. 25, 2016

(54) IMAGE FORMING APPARATUS

(71) Applicant: KYOCERA Document Solutions Inc., Osaka (JP)

(72) Inventors: Masafumi Miki, Osaka (JP); Akihiro Yamaguchi, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 14/800,082

(22) Filed: Jul. 15, 2015

(65) Prior Publication Data

US 2016/0026144 A1 Jan. 28, 2016

(30) Foreign Application Priority Data

Jul. 25, 2014 (JP) ..... 2014-151410

(51) Int. Cl.

| | |
|---|---|
| ***G03G 15/00*** | (2006.01) |
| ***G10K 11/16*** | (2006.01) |
| ***G03G 21/16*** | (2006.01) |
| *G03G 21/18* | (2006.01) |

(52) U.S. Cl.

CPC ..... *G10K 11/16* (2013.01); *G03G 21/1647* (2013.01); *G03G 15/757* (2013.01); *G03G 21/1857* (2013.01); *G03G 2221/1657* (2013.01)

(58) Field of Classification Search

CPC ..... G03G 15/757; G03G 2221/1657
See application file for complete search history.

(56) References Cited

U.S. PATENT DOCUMENTS 5,631,726 A 5/1997 Sawada

FOREIGN PATENT DOCUMENTS

| | | | |
|---|---|---|---|
| JP | H07-304233 | A | 11/1995 |
| JP | H09-230658 | A | 9/1997 |
| JP | H11-038715 | A | 2/1999 |
| JP | 2008-199692 | A | 8/2008 |
| JP | 2008-276018 | A | 11/2008 |

OTHER PUBLICATIONS

The extended European search report issued by the European Patent Office on Dec. 17, 2015, which corresponds to European Patent Application No. 15176484.2-1560 and is related to U.S. Appl. No. 14/800,082.

*Primary Examiner* — Erika J Villaluna
(74) *Attorney, Agent, or Firm* — Studebaker & Brackett PC

(57) ABSTRACT

An image forming apparatus includes a driving force transmitting mechanism transmitting a driving force from a driving source to a rotating member through a plurality of coupled driving force transmitting members. The driving force transmitting mechanism has a supporting member and a drive case. The support member supports the driving source and the rotating members. The drive case is provided on the support member and forms a closed space with the supporting member. The closed space stores the driving force transmitting members. The drive case is formed with a sound insulating part. The sound insulating part has at least either one of concave and convex parts at a position closest to the coupling part of the driving force transmitting members.

6 Claims, 5 Drawing Sheets

IMAGE FORMING APPARATUS

INCORPORATION BY REFERENCE

This application is based on and claims the benefit of priority from Japanese Patent application No. 2014-151410 filed on Jul. 25, 2014, the entire contents of which are incorporated herein by reference.

BACKGROUND

The present disclosure relates to an image forming apparatus including a driving force transmitting mechanism transmitting a driving force from a driving source to a rotating member through driving force transmitting members.

An image forming apparatus is provided with a plurality of rotating members, such as a developing roller, a photosensitive drum, and a fixing roller. These rotating member are coupled to an output shaft of a motor, i.e., the driving source, through a gear train and are rotated by a driving force transmitted from the driving source.

Sometimes, such gear train poses a problem that the coupling part between the gears generates noise (meshing noise). In particular, when a rotation speed of the rotating member is increased in association with the increased image forming speed of the image forming apparatus, the noise is tend to become higher in proportion to the increased rotational speed of the rotating member. Still further, in a color image forming apparatus, because a number of rotating member is greater than that of a monochrome image forming apparatus and a number of gear trains is also increased, noise generating spots has increased.

In order to reduce the noise generated from the coupling part between the gears, there is an image forming apparatus in which a drive cover forming a space with a side plate of an apparatus main body is provided and both ends of rotating shaft of each gear of the gear trains are supported between the drive cover and the side plate. There is also an image forming apparatus in which the circumference of the gear train is covered by a sound insulating case having a sound insulating wall.

However, an enough sound insulating effect may not be obtained only by storing the gear train in the space between the drive cover and the side plate. Still further, because the both ends of the rotating shaft of each gear is supported between the drive cover and the side plate, a structure of the drive cover is complicated, thus increasing its manufacturing cost.

Still further, in the case of covering the circumference of the gear train by the sound insulating cover, it may not able to obtain an enough sound insulating effect because the sound insulating wall is not provided on a front side of the gear coupling part. Still further, because the sound insulating wall is composed of a plurality of partition walls, the structure of the sound insulating case is complicated, thus increasing its manufacturing cost.

SUMMARY

In accordance with an embodiment of the present disclosure, an image forming apparatus includes a driving force transmitting mechanism transmitting a driving force from a driving source to a rotating member through a plurality of coupled driving force transmitting members. The driving force transmitting mechanism has a supporting member and a drive case. The support member supports the driving source and the rotating members. The drive case is provided on the support member and forms a closed space with the supporting member. The closed space stores the driving force transmitting members. The drive case is formed with a sound insulating part. The sound insulating part has at least either one of concave and convex parts at a position closest to the coupling part of the driving force transmitting members.

The above and other objects, features, and advantages of the present disclosure will become more apparent from the following description when taken in conjunction with the accompanying drawings in which a preferred embodiment of the present disclosure is shown by way of illustrative example.

DETAILED DESCRIPTION

Hereinafter, with reference to figures, an image forming apparatus according to an embodiment of the present disclosure will be described.

Figure 1:
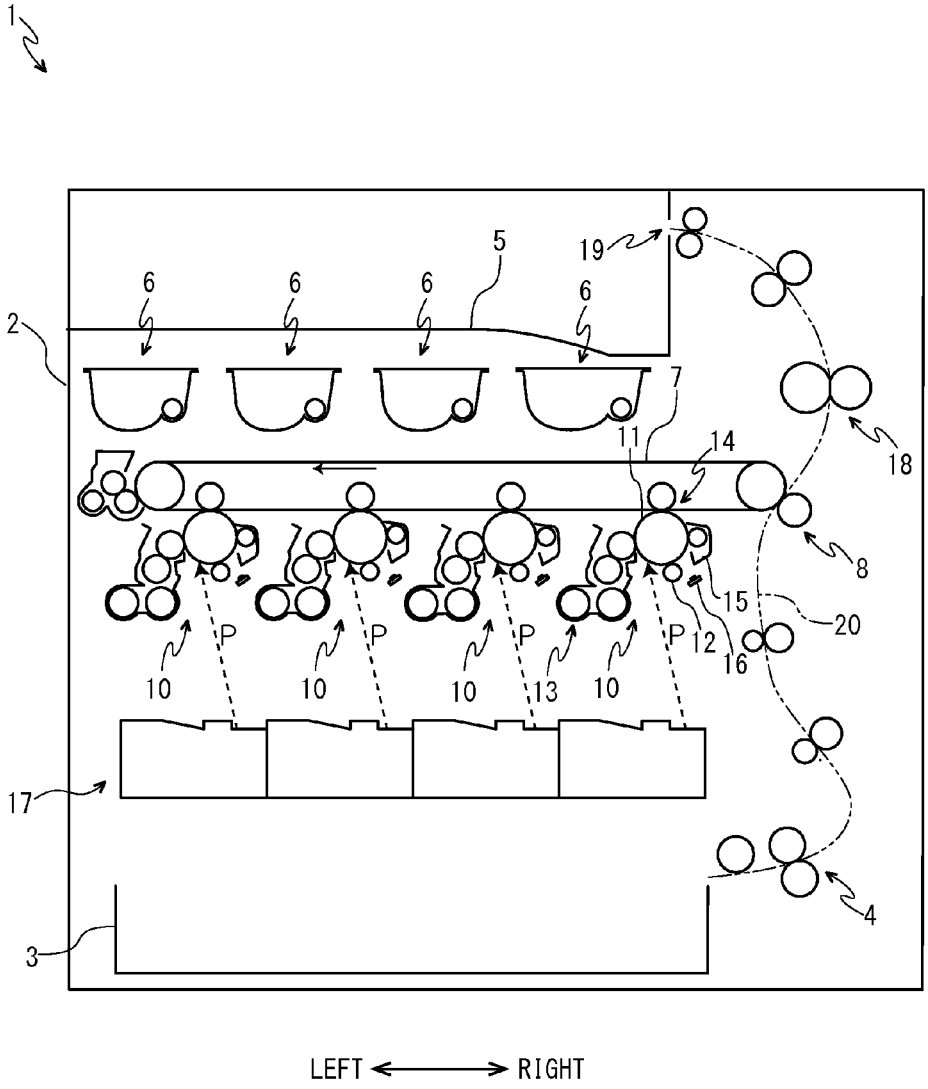
FIG. 1 is a schematic diagram showing a configuration of a full-color printer according to a first embodiment of the present disclosure.

First, with reference to FIG. 1, the entire structure of a color printer 1 (image forming apparatus) will be described. FIG. 1 is a schematic diagram schematically showing a color printer according to an embodiment of the present disclosure. In the following description, a front side of the paper plane of FIG. 1 shows a front side of the color printer 1 and left and right directions are based on a direction viewed from the front side of the color printer 1.

The color printer 1 is provided with a box-like shaped printer main body 2. In a lower part of the printer main body 2, a sheet feeding part 4 configured to feed a sheet from a sheet feeding cassette 3 is provided, and on an upper face of the printer main body 2, a sheet ejecting tray 5 is provided. Inside the printer main body 2, toner containers 6 respectively storing different color (magenta, cyan, yellow and black) toner (developer) are arranged in an upper space. Under the toner containers 6, an intermediate transferring belt 7 is bridged between a plurality of rollers. On one end (right end in FIG. 1), a second transferring part 8 is formed. Under the intermediate transferring belt 7, four image forming parts 10 is provided for respective toner colors.

In the image forming part 10, a photosensitive drum 11 as an image carrier is rotatably provided. Around the photosensitive drum 11, a charger 12, a development unit 13, a transfer roller 14, a cleaning device 15 and a static eliminator 16 are arranged along a rotating direction of the photosensitive drum 11. Under the image forming parts 10, an exposure device 17 containing a laser scanning unit (LSU) is arranged. On an upper right side of the image forming parts 10, a fixing device 18 is provided. Above the fixing device 18, a sheet ejecting unit 19 facing the sheet ejecting tray 5 is provided.

In the printer main body 2, a main sheet conveying path 20 is formed so as to extend vertically from the sheet feeding part 4 to the sheet ejecting unit 19 through the second transferring part 9 and the fixing device 18.

Next, the operation of forming an image by the color printer 1 having such a configuration will be described. When image data is inputted from a computer or the like connected to the color printer 1, the image forming operation is carried out as follows.

After the surface of the photosensitive drum 11 is charged by the charger 12, the exposure device 17 exposes the surface of the photosensitive drum 24 with a laser light (refer to the dotted line p in FIG. 1) in accordance to the image data to form an electrostatic latent image on the surface of the photosensitive drum 11. The electrostatic latent image is then developed into a toner image of respective color by the developing unit 13. The toner images are first-transferred on the intermediate transferring belt 7 by the transferring roller 14. The above-mentioned operation is repeated in order by the respective image forming parts 10, thereby forming a full color toner image onto the intermediate transferring belt 7. Incidentally, toner and residual electric charge remained on the photosensitive drum 11 is removed by the cleaning device 14 and the static eliminator 15, respectively.

On the other hand, the sheet fed from the sheet feeding cassette 3 by the sheet feeding part 4 or a bypass tray (not shown) is conveyed to the second transferring part 8 in a suitable timing for the above-mentioned image forming operation. Then, in the second transferring part 8, the full color toner image on the intermediate transferring belt 7 is second-transferred onto the sheet. The sheet with the second-transferred toner image is conveyed to a downstream side along the main conveying path 20 to enter the fixing part 18, and then, the toner image is fixed on the sheet in the fixing part 18. The sheet with the fixed toner image is ejected from the sheet ejecting unit 19 onto the ejected sheet tray 5.

In the color printer 1 described above, a driving force is applied to rotating members, such as the photosensitive drum 11, a developing roller included in the developing unit 13, a fixing roller included in the fixing unit 18, and a sheet feed roller included in the sheet feeding part 4, from a driving source, such as a motor, through a plurality of coupled driving force transmitting members.

Figure 2:
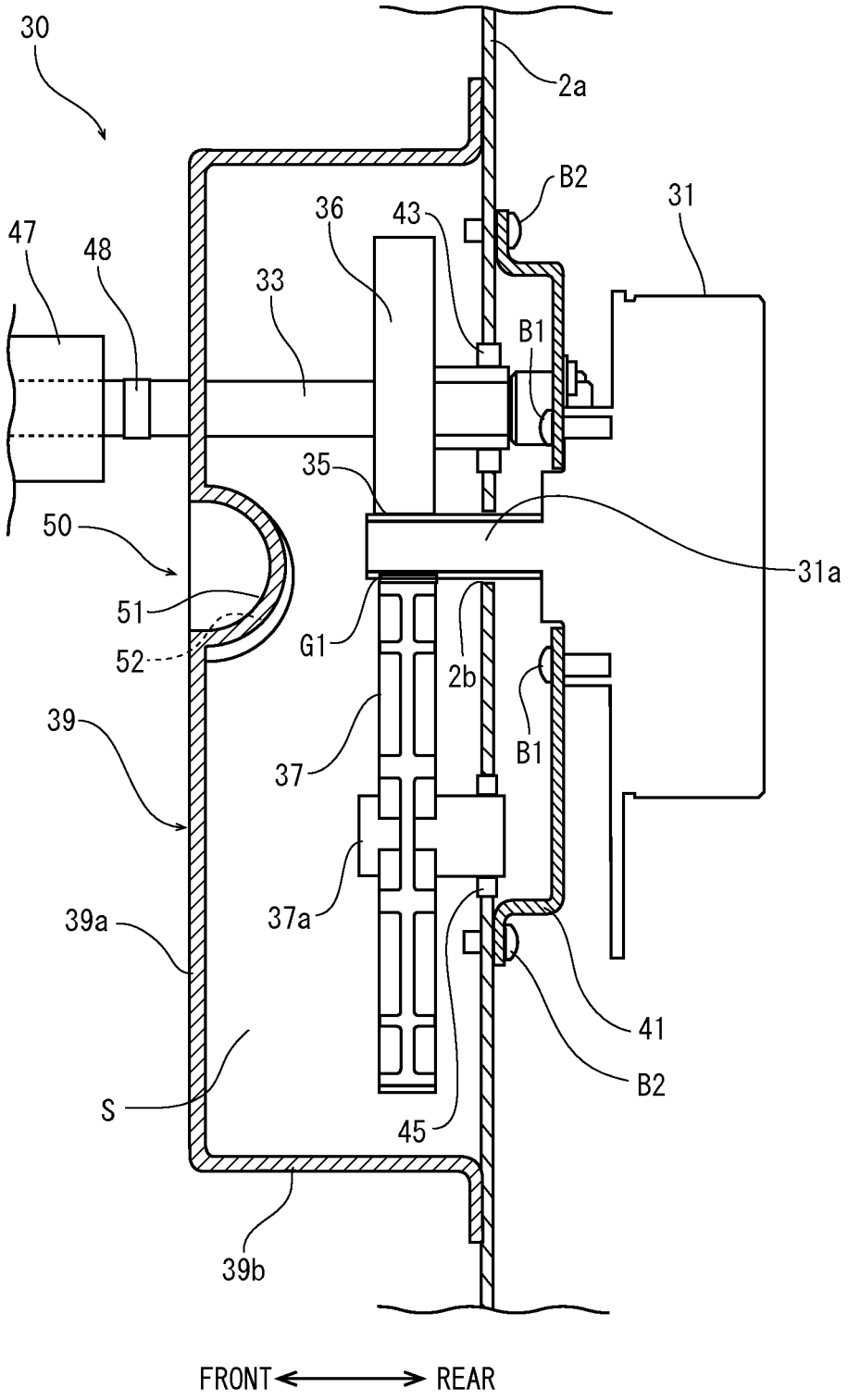
FIG. 2 is a side view showing a mechanism transmitting driving force from a driving source to a rotating member in the color printer of the first embodiment of the present disclosure.
Figure 3:
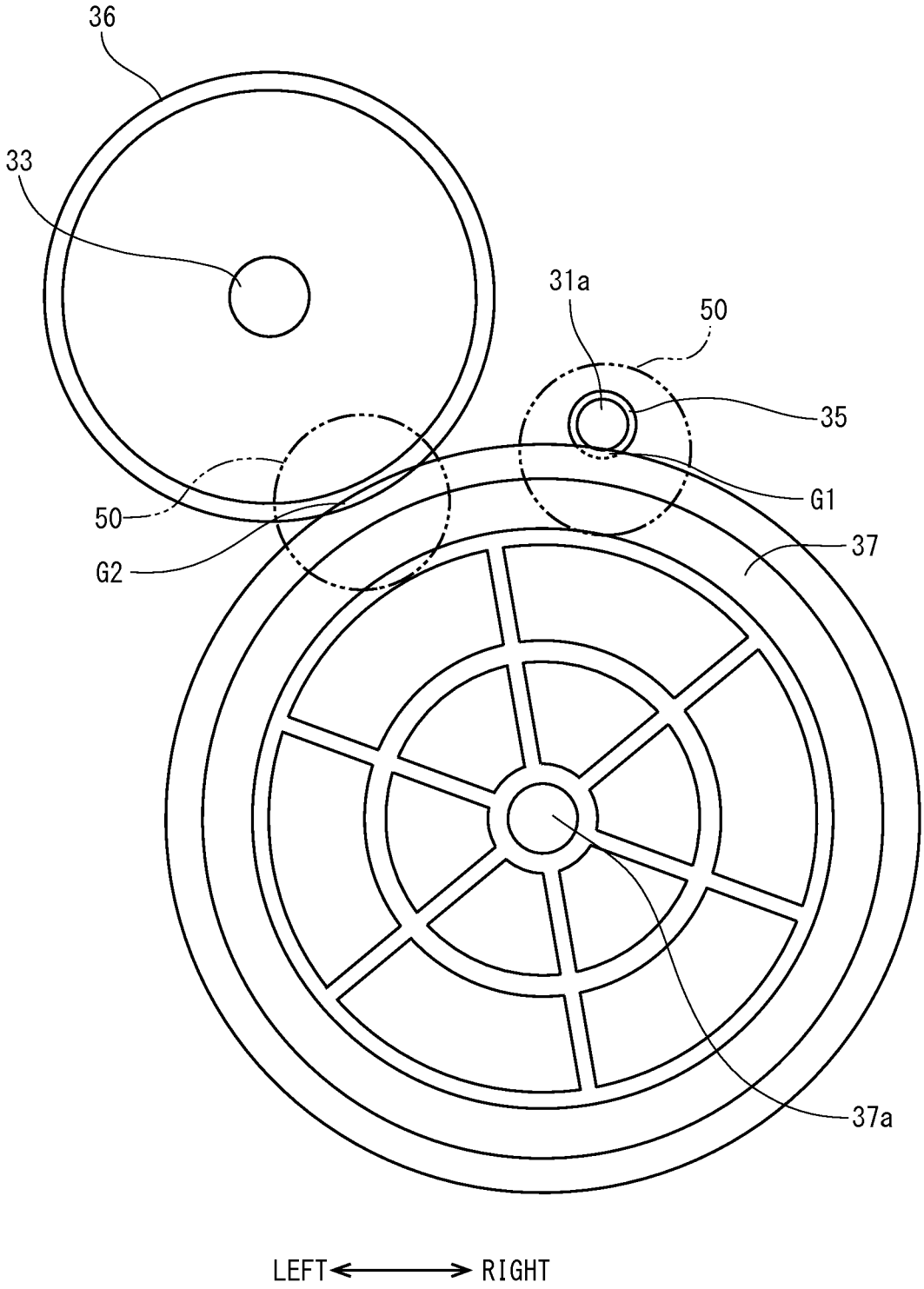
FIG. 3 is a front view showing driving force transmitting members in the color printer of the first embodiment of the present disclosure.

With reference to FIGS. 2 and 3, a mechanism (driving force transmitting mechanism) 30 transmitting the driving force from the driving source to the rotating members through the plurality of coupled driving force transmitting members will be described. FIG. 2 is a side view showing the rotating members, the driving source and the driving force transmitting members. FIG. 3 is a front view showing the driving force transmitting members. The printer main body 2 includes a front side plate (not shown) and a rear side plate 2*a* (supporting member) which are disposed face to face in the forward and rearward directions. The driving force transmitting mechanism 30 is supported by the rear side plate 2*a*.

The driving force transmitting mechanism 30 includes a motor 31 (driving source) generating a rotational force (driving force), an output shaft 33 to which the rotational force is transmitted, a motor shaft gear 35, an output gear 36, and an intermediate gear 37 (driving force transmitting members) transmitting the rotational force of the motor 31 to the output shaft 33, and a drive case 39 storing the respective gears.

The motor 31 is fixedly attached to a motor mounting plate 41 by screws B1 with a rotating shaft 31*a* directed forward. The motor mounting plate 41 is fixedly attached to a rear side surface of the rear side plate 2*a* by screws B2 such that the rotating shaft 31*a* of the motor 31 protrudes forward through a through hole 2*b* formed through the rear side plate 2*a*. The motor shaft gear 35 is provided coaxially with the rotating shaft 31*a* of the motor 31.

The output shaft 33 is disposed in front of the rear side plate 2*a* and is rotatably supported by the rear side plate 2*a* through a bearing 43. The output gear 36 is provided coaxially with the output shaft 33.

The intermediate gear 37 is disposed in front of the rear side plate 2*a* and a rotating shaft 37*a* coaxially provided with the intermediate gear 37 is rotatably supported by the rear side plate 2*a* through a bearing 45. The intermediate gear 37 meshes (is coupled) with the motor shaft gear 35 at a position slightly on a right side from an apex portion thereof and meshes (is coupled) with the output gear 36 at a position slightly on a left side of the apex portion thereof. This arrangement makes it possible to decelerate and to transmit the rotational force of the motor 31 to the output shaft 33 through the motor shaft gear 35, the intermediate gear 37, and the output gear 36.

The drive case 39 is a rectangular parallelepiped box-like member whose rear side face is opened, and has a front plate 39*a* and side plates 39*b* facing with each other in the vertical directions and the left and right directions. The drive case 39 is fixedly attached to the rear side plate 2*a* by screws or the like with the front plate 39*a* faced a front surface of the rear side plate 2*a* in parallel. Thereby, a parallelepiped closed space S is formed between the drive case 39 and the rear side plate 2*a*. The drive case 39 is made of resin for example.

The motor shaft gear 35, the intermediate gear 37, and the output gear 36 are stored in the closed space S formed between the drive case 39 and the rear side plate 2*a*. A through hole (not shown) through which the output shaft 33 penetrates is formed through the front plate 39*a* of the drive case 39. A rotating member 47, such as a developing roller of the developing unit 13 for example, is connected to the output shaft 33 protruding through the through hole by a coupling 48.

The front plate 39*a* of the drive case 39 is formed with sound insulating parts 50 in front of (in a direction intersecting with a direction in which the gears are coupled) a meshing part G1 (coupling part, see FIG. 3, not shown in FIG. 2) where the motor shaft gear 35 and the intermediate gear 37 are meshed each other and a meshing part G2 (coupling part) where the intermediate gear 37 and the output gear 36 are meshed each other, respectively. In the sound insulating parts 50, semispherical concave parts 51 and 52 recessed rearward are formed respectively. As shown in FIG. 3, the respective concave parts 51 and 52 are formed such that an entire range of the meshing part G1 of the motor shaft gear 35 and the intermediate gear 37 and an entire range of the meshing part G2 of the intermediate gear 37 and the output gear 36 are included respectively within projection planes (ranges surrounded by two dot chain lines in FIG. 3) where the concave parts 51 and 52 are projected rearward on the rear side plate 2*a*. Specifically, the respective concave parts 51 and 52 are formed such that the meshing parts G1 and G2 are positioned respectively at centers of the projection planes.

In the driving force transmitting mechanism 30 constructed as described above, when the motor 31 is driven, the output shaft 33 is rotated through the motor shaft gear 35, the intermediate gear 37 and the output gear 36. At this time, meshing noise is generated from the meshing part G1 of the motor shaft gear 35 and the intermediate gear 37 and from the meshing part G2 of the intermediate gear 37 and the output gear 36.

Figure 4:
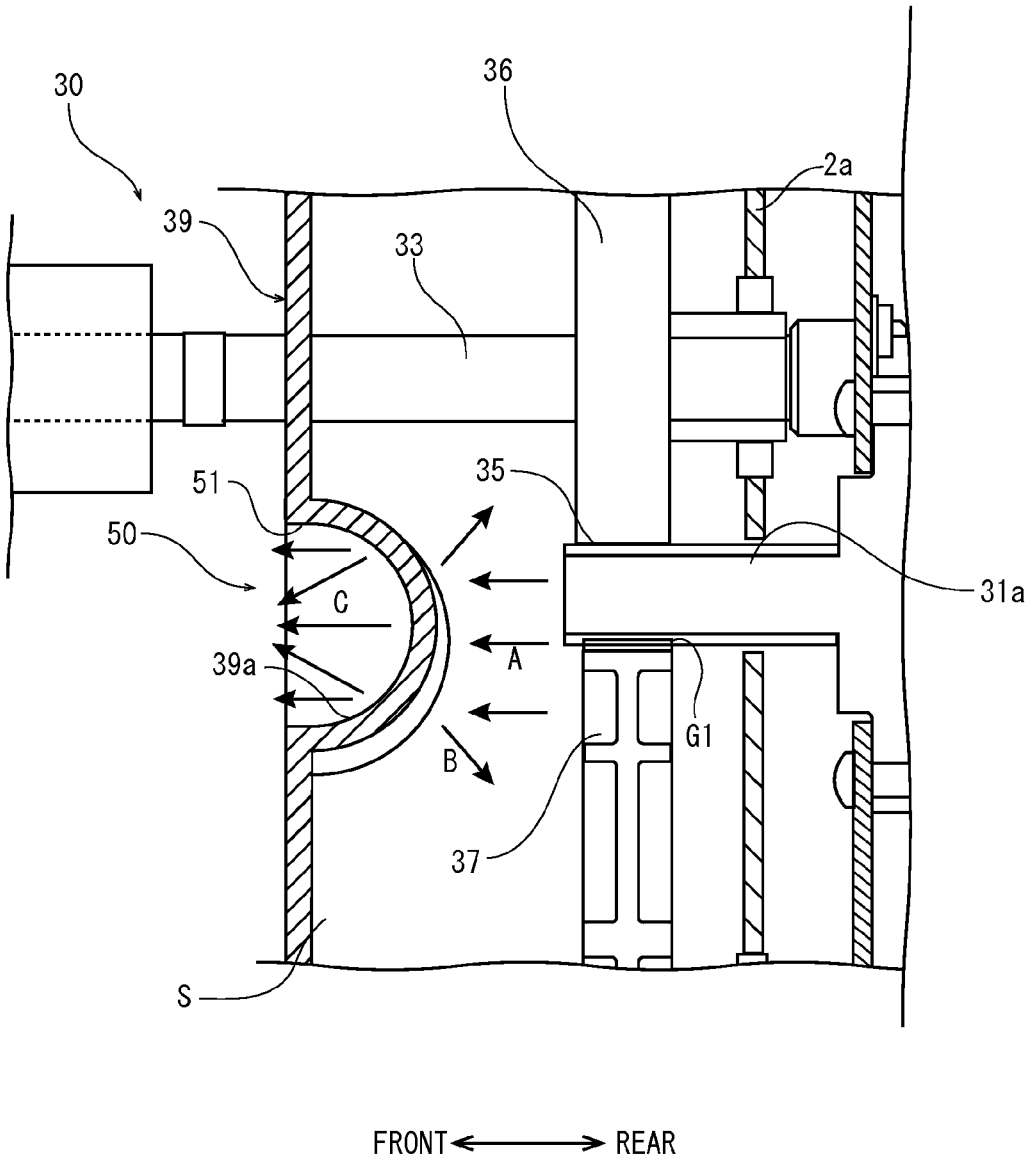
FIG. 4 is a side view explaining progress of sounds generated from a coupling part of the driving force transmitting members in the color printer of the first embodiment of the present disclosure.

Progress of the meshing noise generated at the meshing part G1 will be described with reference to FIG. 4. FIG. 4 is a side view showing the progress of the meshing noise. As indicated by arrows A in FIG. 4, the meshing sound progressed forward from the meshing part G1 hits against a rear face of the concave part 51 at the sound insulating part 50 of the drive case 39. Then, a part of the meshing noise reflects within the closed space S (see arrows B in FIG. 4), and another part of the meshing noise is absorbed by the front plate 39*a*. Still further, a part thereof transmits through the front plate 39*a*. The transmitted sounds progress, as indicated by an arrow C in FIG. 4, from a front face of the concave part 51. That is, the meshing noises generated from the meshing part G1 do not only progress straightly from the front face of the concave part 51, but also diffuse in various directions. Thereby, the meshing noise generated from the meshing part G1 is reduced by passing through the sound insulating part 50.

As described above, in the driving force transmitting mechanism 30 of the present embodiment, because the sound insulating part 50 is formed in front of the meshing parts G1 and G2, the meshing noises progressing forward from the meshing parts G1 and G2 are diffused at the concave parts 51 and 52 provided in the sound insulating part 50. This makes it possible to reduce the sound leaking out of the drive case 39, particularly the sound progressing forward. Since a user often stands in front of the color printer 1 in operating the color printer 1, the user hardly feels the noise by reducing the meshing noise progressing forward from the color printer 1.

Still further, because the sound insulating part 50 is formed so as to include the entire ranges of the meshing parts G1 and G2, it is possible to offer the diffusing action of the respective concave parts 51 and 52 to almost all ranges on a front side in the progressing direction of the meshing noises generated from the meshing parts G1 and G2. Thereby, the noises can be reduced more reliably.

Still further, because the sound insulating part 50 is formed into the semispherical concave parts 51 and 52, the drive case 39 can be formed by a simple machining process. It is also unnecessary to add a dedicated member. Accordingly, mass-productivity of the drive case 39 can be improved, cutting its manufacturing cost. Therefore, this arrangement is effective for the color printer 1 including numbers of rotating members in particular. It is noted that the shape of the concave parts 51 and 52 may be a polygonal pyramid, such as a quadrangular pyramid and a triangular pyramid. Still further, a hollow convex part protruding forward from the front plate 39*a* of the drive case 39 may be formed. However, in the case when the convex part is formed, there is a possibility that the convex part interferes with parts, such as the rotating member 47, disposed on the front side of the drive case 39, so that it is preferable to form the concave part recessed rearward. Alternatively, pluralities of concave and convex parts may be formed at one sound insulating part 50. Alternatively, the concave parts and convex parts may be solid.

Figure 5:
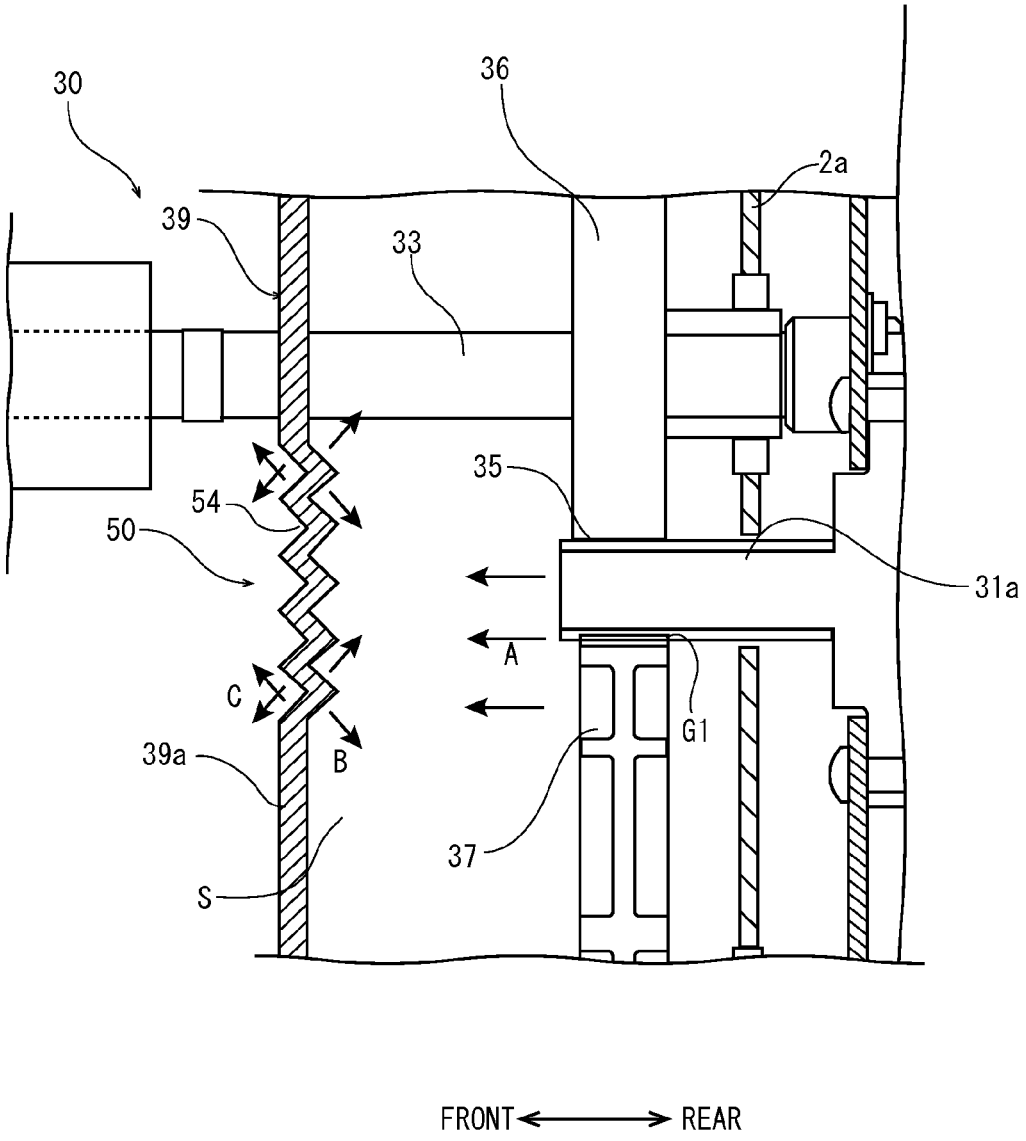
FIG. 5 is a side view explain progress of sounds generated from a coupling part of a driving force transmitting members in a color printer according to a second embodiment of the present disclosure.

Next, a driving force transmitting mechanism of a color printer according to a second embodiment will be described with reference to FIG. 5.

According to the second embodiment, the sound insulating part 50 has a corrugate shape in which concave parts 54 having a triangular sectional view are continuously formed. The concave part 54 is formed by bending the front plate 39*a* of the drive case 39 in the rear direction.

In this driving force transmitting mechanism, meshing noise (see arrows A in FIG. 5) progressing forward from the meshing part G1 hits against a rear face of each concave part 54. Then, a part of the meshing noise diffuses (see an arrow B in FIG. 5) by reflecting within the closed space S, and another part thereof is absorbed by the front plate 39*a*. Still further, the sound transmitting through the front plate 39*a* do not only progress straightly from the front face of each concave part 54, but also diffuse in oblique directions from the front plate 39*a*. This makes it also possible to reduce the meshing noises generated from the meshing parts G1 and G2 by passing through the sound insulating part 50.

In the embodiments of the present disclosure, the sound insulating part 50 may be provided only at one place of the meshing part G1 of the motor shaft gear 35 and the intermediate gear 37. Because a rotational speed of the motor shaft gear 35 is fast, the meshing noise generated from the meshing part G1 of the motor shaft gear 35 and the intermediate gear 37 is larger than the meshing noise generated from the other meshing part G2. Accordingly, it is possible to obtain an enough noise reducing effect by forming the sound insulating part 50 only for the meshing part G1 of the motor shaft gear 35 and the intermediate gear 37.

Still further, while the driving force transmitting mechanism 30 in which one intermediate gear 37 is provided between the motor shaft gear 35 and the output gear 36 has been described in the embodiments of the present disclosure, there may be a plurality of intermediate gears 37 between the motor shaft gear 35 and the output gear 36. In this case, the drive case 39 is formed so as to store all of the intermediate gears 37, the motor shaft gear 35 and the output gear 36.

Still further, while the case where the motor 31 and the output shaft 33 are supported by the rear side plate 2*a* has been described in the embodiments of the present disclosure, the motor 31 and the output shaft 33 may be supported by left and right side plates facing in the left and right directions of the printer main body 2. In this case, by forming the sound insulating part 50 at the part closest to the meshing parts G1 and G2 in the drive case 39, it is possible to reduce the sound leaking out of the drive case 39.

Still further, while the case where the driving force transmitting members are gears has been described in the embodiments of the present disclosure, it is also possible to use pulleys and a timing belt other than the gears. In the case of using the timing belt, the sound insulating part 50 is formed at a position facing a meshing part of the pulley around which the timing belt is wrapped and a gear.

The embodiment was described in a case of applying the configuration of the present disclosure to the color printer 1. On the other hand, in another embodiment, the configuration of the disclosure may be applied to another image forming apparatus, such as a copying machine, a facsimile or a multifunction peripheral, except for the printer 1.

While the present disclosure has been described with reference to the particular illustrative embodiments, it is not to be restricted by the embodiments. It is to be appreciated that those skilled in the art can change or modify the embodiments without departing from the scope and spirit of the present disclosure.

What is claimed is:

1. An image forming apparatus comprising:

a driving force transmitting mechanism transmitting a driving force from a driving source to a rotating member through a plurality of coupled driving force transmitting members, wherein the driving force transmitting mechanism includes a support member supporting the driving source and the rotating member; and a drive case provided on the support member and forming a closed space with the support member, in which the closed space stores the driving force transmitting members and wherein the drive case is formed with a sound insulating part at a position closest to a coupling part of the driving force transmitting members, wherein the driving force transmitting members are supported by the support member in a cantilever manner, the coupling part of the driving force transmitting members is provided in front of the support member, and wherein the sound insulating part is formed into a semi-spherical or polygonal pyramid concave shape protruded toward the coupling part, and wherein the sound insulating part is formed so as to face to the coupling part of the driving force transmitting members.

2. The image forming apparatus according to claim 1, wherein the sound insulating part is formed such that the coupling part is included within a projection plane where the sound insulating part is projected rearward to the support member.

3. The image forming apparatus according to claim 2, wherein the sound insulating part is formed such that the coupling part is positioned at a center of the projection plane.

4. The image forming apparatus according to claim 1, wherein the driving force transmitting members comprise a motor shaft gear, an output gear and an intermediate gear, and the sound insulating part is formed in at least a coupling part of the motor shaft gear and the intermediate gear.

5. An image forming apparatus comprising:

a driving force transmitting mechanism transmitting a driving force from a driving source to a rotating member through a plurality of coupled driving force transmitting members, wherein the driving force transmitting mechanism includes:

a support member supporting the driving source and the rotating member; and a drive case provided on the support member and forming a closed space with the support member, in which the closed space stores the driving force transmitting members, wherein the drive case is formed with a sound insulating part at a position closest to a coupling part of the driving force transmitting members, wherein the driving force transmitting members are supported by the support member in a cantilever manner, the coupling part of the driving force transmitting members is provided in front of the support member, wherein the sound insulating part is formed so as to face to the coupling part of the driving force transmitting members, and wherein the sound insulating part is formed into a corrugate shape in which a plurality of concave parts, formed by bending toward the coupled part, are continuously arrayed.

6. The image forming apparatus according to claim 5, wherein the driving force transmitting members comprise a motor shaft gear, an output gear and an intermediate gear, and the sound insulating part is formed in at least a coupling part of the motor shaft gear and the intermediate gear.

* * * * *